US010258129B2

(12) United States Patent
De Vries

(10) Patent No.: US 10,258,129 B2
(45) Date of Patent: Apr. 16, 2019

(54) QUICK RELEASE ZIPPER LOCK FOR A BAG

(71) Applicant: Stephen Charles De Vries, Eagan, MN (US)

(72) Inventor: Stephen Charles De Vries, Eagan, MN (US)

(73) Assignee: Stephen Charles De Vries, Eagan, MN (US)

( * ) Notice: Subject to any disclaimer, the term of this patent is extended or adjusted under 35 U.S.C. 154(b) by 0 days.

(21) Appl. No.: 15/582,139

(22) Filed: Apr. 28, 2017

(65) Prior Publication Data

US 2017/0325558 A1 Nov. 16, 2017

Related U.S. Application Data

(60) Provisional application No. 62/336,077, filed on May 13, 2016.

(51) Int. Cl.

| | |
|---|---|
| ***A44B 19/30*** | (2006.01) |
| ***A45C 13/10*** | (2006.01) |
| ***A45C 13/18*** | (2006.01) |

(52) U.S. Cl.

CPC ..... *A45C 13/18* (2013.01); *A44B 19/301* (2013.01); *A45C 13/103* (2013.01)

(58) Field of Classification Search

CPC ..... A45C 13/18; A45C 13/103; A44B 19/301
USPC ..... 383/38, 97
See application file for complete search history.

(56) References Cited

U.S. PATENT DOCUMENTS

| | | | | |
|---|---|---|---|---|
| 9,512,647 | B2 * | 12/2016 | Meersschaert | E05B 35/105 |
| 2009/0226050 | A1 * | 9/2009 | Hughes | A45C 13/18 382/124 |
| 2017/0245612 | A1 * | 8/2017 | Janzen | A45C 13/103 |

* cited by examiner

*Primary Examiner* — Jes F Pascua
(74) *Attorney, Agent, or Firm* — Thomas J. Oppold; Larkin Hoffman Daly & Lindgren, Ltd.

(57) ABSTRACT

A bag having a quick release zipper lock. The bag has an internal compartment with a zipper closure. A locking rod is secured to an inner side of the zipper slider of the zipper closure. A zipper lock is secured within the internal compartment at the closed end of the zipper closure which lockably receives the locking rod. A quick release mechanism has a pull release cord with an end disposed external to the internal compartment. A cable couples the quick release mechanism to the zipper lock. Whereby upon exerting a pulling force on the pull release cord, the zipper lock releases the locking rod so as to permit the zipper slider to be moved from the closed end toward the open end for accessing the internal compartment of the bag.

17 Claims, 5 Drawing Sheets

QUICK RELEASE ZIPPER LOCK FOR A BAG

BACKGROUND

Miniature padlocks which utilize a key or a combination lock are well known and frequently used on luggage, particularly luggage that is checked at airports, train stations and bus stations, to ensure the zippers on the luggage do not inadvertently open during handling and also to discourage theft of the contents of the luggage. To lock the bags, the shackle of the miniature padlock is inserted through the eyelets of the pull-tabs of abutting zipper sliders or alternatively the through the eyelet of a zipper pull-tab and a hoop secured at the end of the zipper Such miniature padlocks are also used to lock the zippers on backpacks, computer bags, satchels and purses to prevent the theft of the contents of such bags, but the use of such locks can be tedious, particularly if quick or frequent access to the contents of the bag is needed. As a result, users often choose not lock the zippers of such bags making the contents of the bag vulnerable to theft. Additionally, if the luggage or bag has multiple zippered compartments, a separate padlock is required for each zippered compartment making access to the various compartments even more tedious. Furthermore, the use of padlocks to secure the zippered compartments requires the user to maintain possession of one or more keys and/or to remember the combinations for the padlocks.

To discourage or avoid theft of the bag contents, it is usually sufficient to simply make the zippers more difficult to unzip so the intended thief moves to an easier target. For example, it is a common practice of thieves to distract the bag owner while the thief alone, or with another conspiring thief, unzips the bag and removes an item from the bag while the owner has the bag over his or her shoulder or while the bag is sitting next to the owner. Another common practice among thieves, is to partially unzip a bag as one or more thieves walk past a target bag while it is being carried by the owner until it is sufficiently opened to allow one of the thieves to reach in and snatch an item from the bag. However, if the zipper is somehow secured such that it is not so easily unzipped, the thieves would be discouraged from targeting the bag and will likely move on to an easier target.

Accordingly, there is a need for a lock for zippers on luggage, backpacks, computer bags, satchels, purses and the like which allows the zippers to be securely locked to prevent the zippers from inadvertently unzipping and/or to discourage or avoid theft of the contents therein, but which can be quickly unlocked when desired by the owner to gain access to any zippered compartment of the bag.

DESCRIPTION

Figure 1:
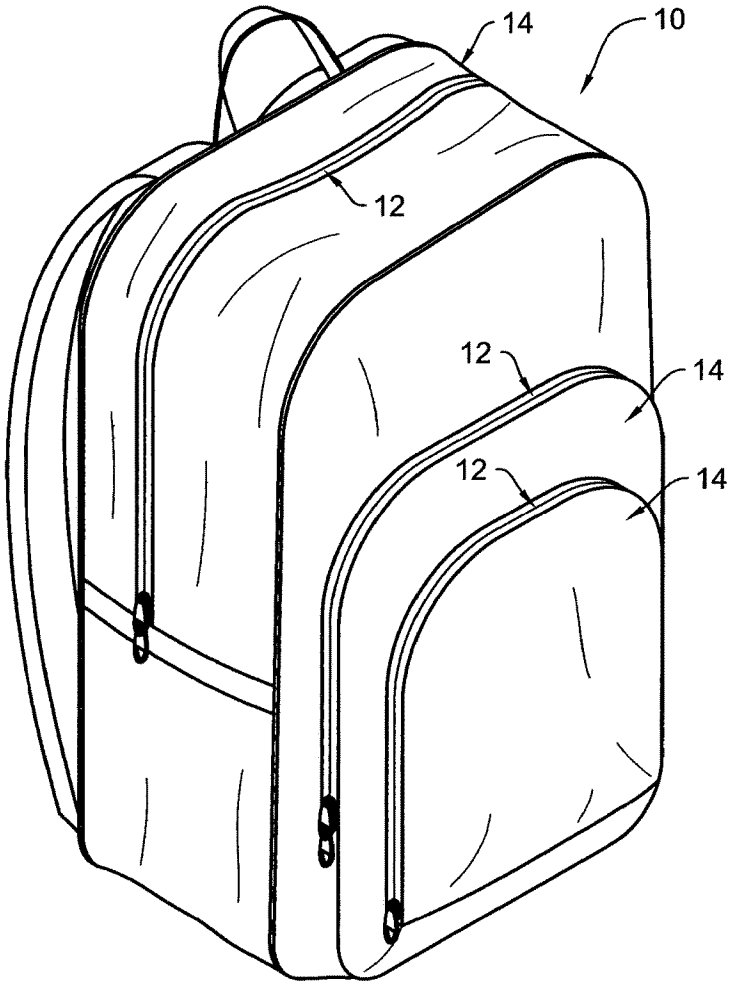
FIG. 1 is a perspective view of a bag in the form of a backpack incorporating a quick release zipper lock (not visible in FIG. 1).

Referring to the drawings wherein like reference numerals designate the same or corresponding elements throughout the several views, FIG. 1 illustrates a bag 10 in the form of a backpack, incorporating a quick release zipper lock 100 which is substantially hidden from view in FIG. 1. Although the bag 10 is shown in FIG. 1 in the form of a backpack, it should be understood that the bag 10 may be any size or shape bag having zippered compartments, including not only backpacks, but luggage, computer bags, satchels, purses, and the like (each hereinafter a "bag").

The bag 10 is shown as having multiple zippered compartments 14, with the zipper closures 12 shown in the zipped or closed position. As best viewed in FIG. 4, the zippers 12 are conventional zippers comprising a slider 16 to which is secured a pull tab 18. The slider 16 slides along the zipper chain 20 comprising mating chain halves 22, 24 of interlocking teeth 26 running along adjacently sides of the tape 28, 30. The opposite sides of the tape 28, 30 are stitched or otherwise fixed to the material 32 comprising the body of the bag defining the compartments 14.

Figure 2:
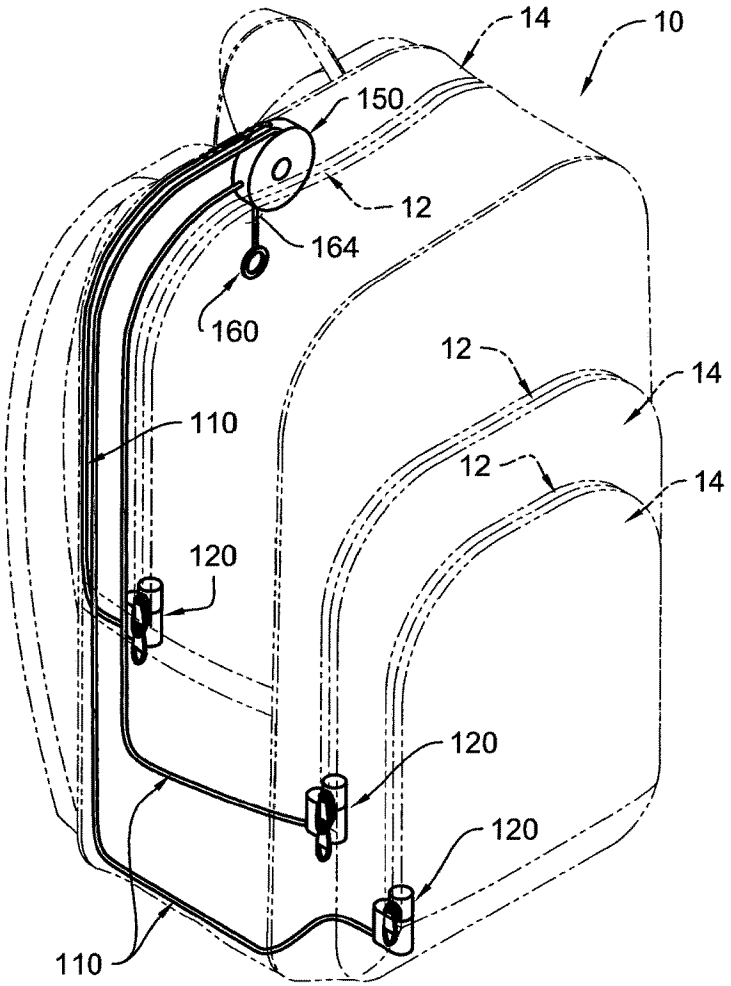
FIG. 2 is the same perspective view of the bag of FIG. 1, but showing the body of the bag in phantom lines and illustrating an embodiment of a quick release zipper lock internal to the bag.

FIG. 2 is the same perspective view of the bag 10 as in FIG. 1, but showing the body of the bag 10 in phantom lines and illustrating an embodiment of the components comprising the quick release zipper lock 100 internal to the bag 10.

The quick release zipper lock 100 comprises one or more cables 110, one or more zipper locks 120 and a release mechanism 150 having a release actuator 160.

In the embodiment illustrated a separate cable 110 is routed internally within the bag 10 between a each zipper lock 120 and the release mechanism 150. It should be appreciated that the number of cables 110 and zipper locks 120 will vary depending on the number of zippered compartments 14 desired to be locked. The cables 110 are preferably similar to bicycle brake cables in which a cable rope 112 slides within a stationary sheath 114 secured to the zipper locks 120 and to the release mechanism 150.

Figure 3:
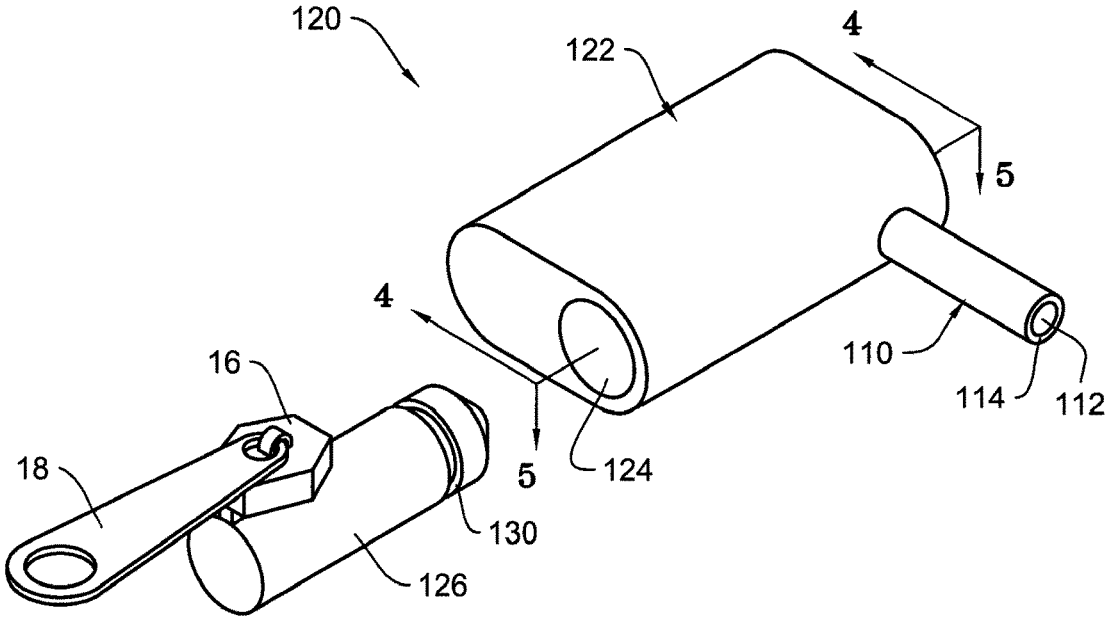
FIG. 3 is a perspective view of an embodiment of the receiver and locking rod comprising the zipper lock with the zipper removed for clarity.
Figure 4:
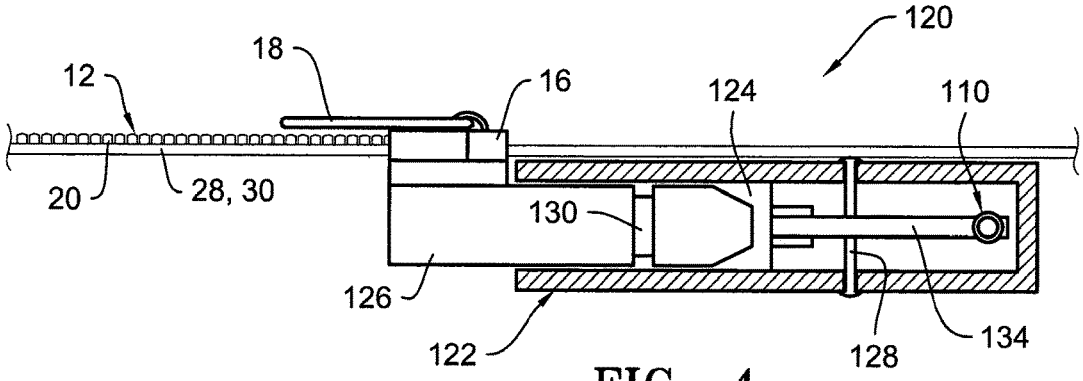
FIG. 4 is a cross-sectional view of the zipper lock as viewed along line 4-4 of FIG. 3, with the zipper lock shown in the locked position.
Figure 5:
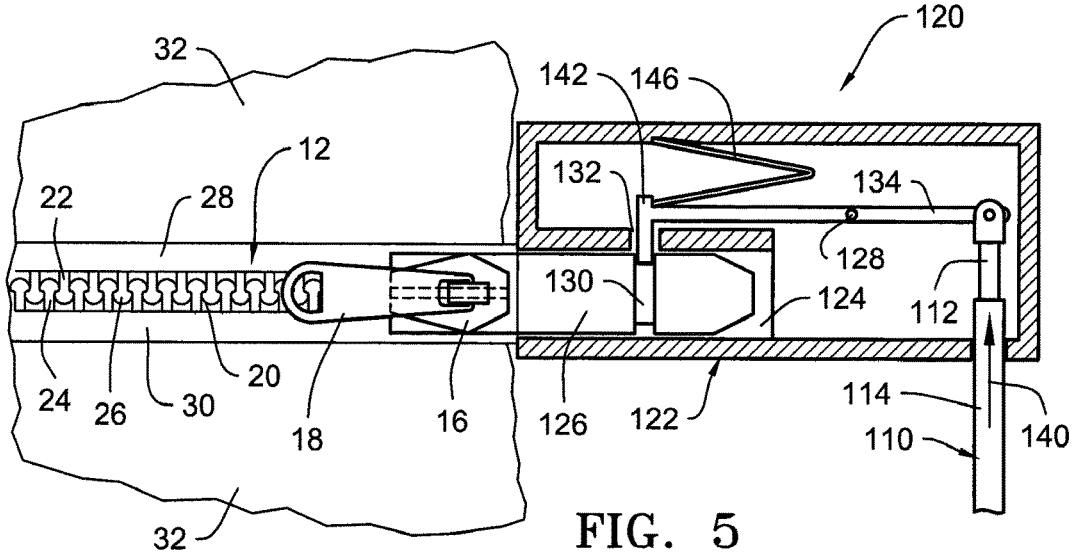
FIG. 5 is a cross-sectional view of the zipper lock as viewed along line 5-5 of FIG. 3, with the zipper lock shown in the locked position.
Figure 6:
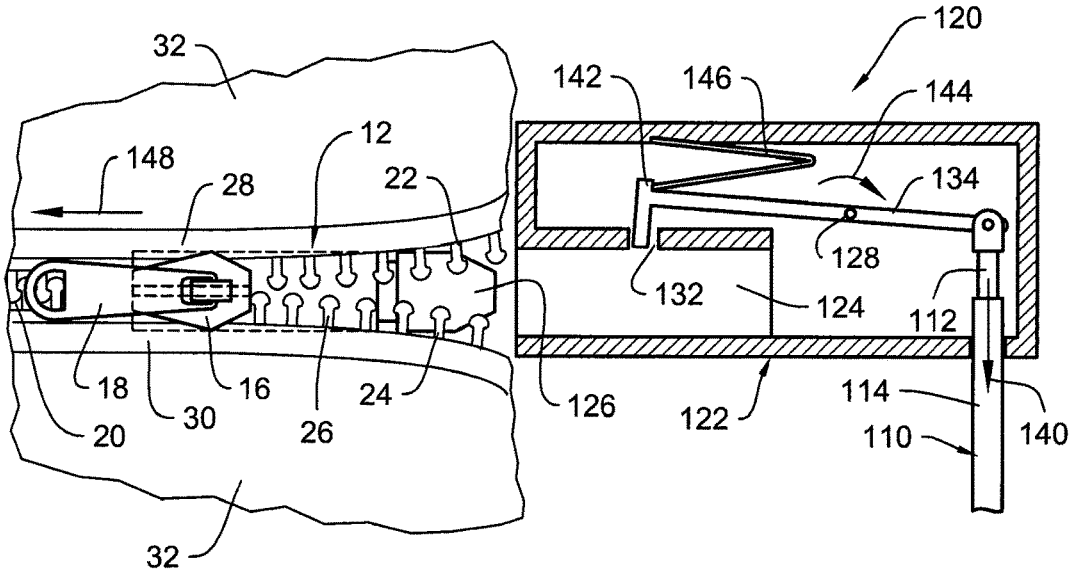
FIG. 6 is the same cross-sectional view of the zipper lock of FIG. 5 but showing the zipper lock in the unlocked position with the zipper partially unzipped.

An embodiment of the zipper lock 120 is illustrated in FIGS. 3-6, wherein FIG. 3 is a perspective view of the zipper lock 120; FIG. 4 is a cross-sectional view along line 4-4 of FIG. 3; FIG. 5 is a cross-sectional view along line 5-5 of FIG. 3; and FIG. 6 is the same view as FIG. 5 but showing the zipper lock 120 in the unlocked position with the zipper 12 partially unzipped. The zipper lock 120 comprises a receiver 122 having an internal bore 124 which receives a locking rod 126 secured to the inner or underside of the zipper slider 16. The locking rod 126 includes an annular recess 130 which aligns with an aperture 132 (FIGS. 5 and 6) in the wall of the bore 124 when the locking rod 126 is fully received within the bore 124. As illustrated in FIGS. 5 and 6, a rocker 134 is pivotally secured within the receiver 122 by a pin 128. One end of the rocker 134 is secured to the end of the cable rope 112 of the cable 110. The other end of the rocker 134 includes a leg 142 positioned to extend into and retract from the aperture 132 in the bore 124 as the rocker 134 pivots about the pin 128 (as indicated by arrow 144) as the cable rope 112 extends and retracts. A spring 146 biases the rocker 132 such that the leg 142 is normally extended into the aperture 132 of the bore 124. It should be appreciated that the sheath 114 of the cable 110 is attached to the receiver 122 such that the sheath 114 remains fixed with respect to the receiver 122 while the cable rope 112 is free to extended or retracted (as indicated by arrows 140) with respect to the stationary sheath 114.

Figure 7:
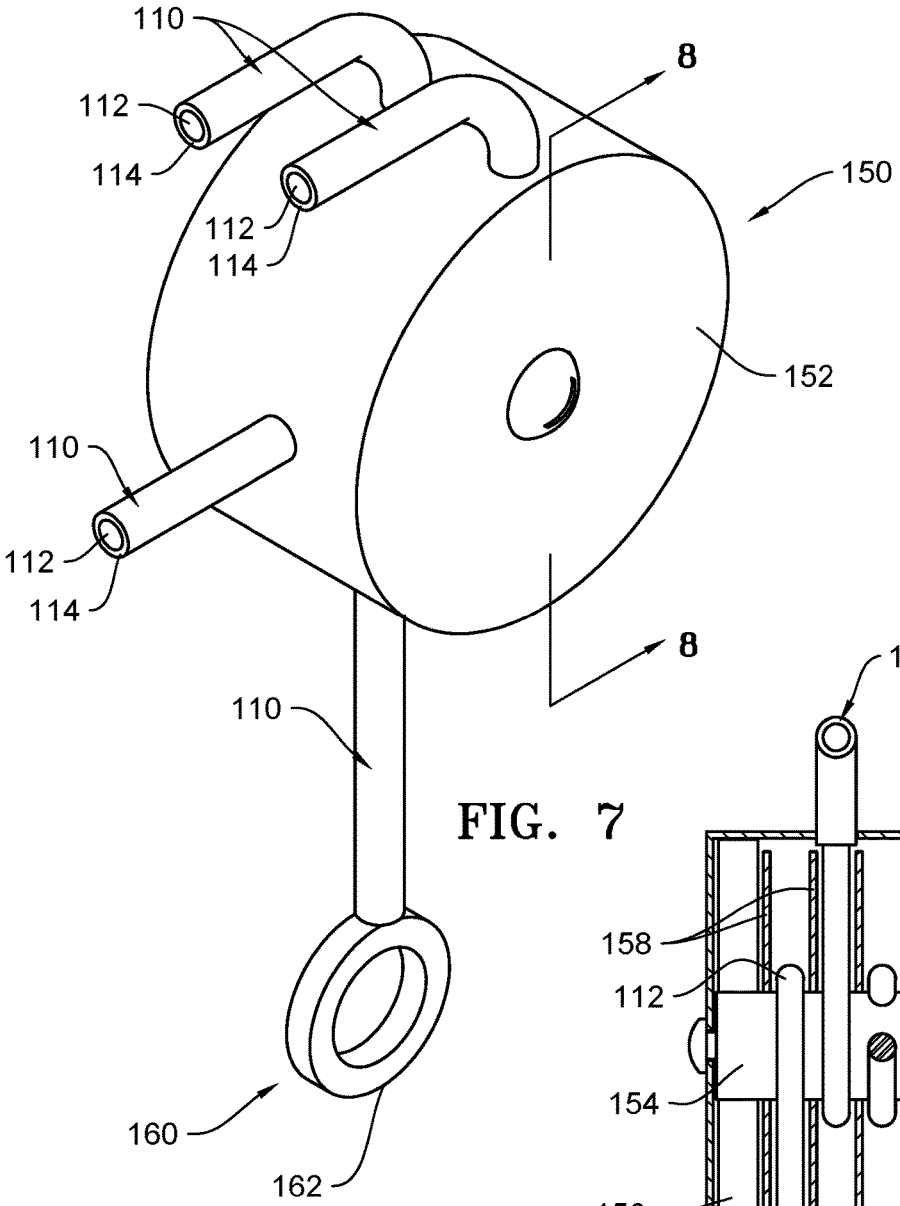
FIG. 7 is a perspective view of an embodiment of the quick release mechanism.
Figure 8:
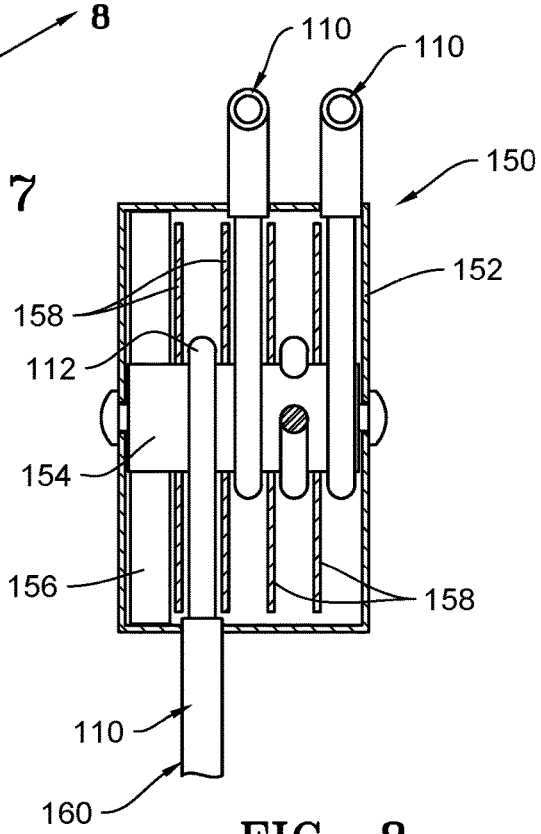
FIG. 8 is a cross-sectional view of the quick release mechanism as viewed along line 8-8 of FIG. 7.

FIG. 7 is a perspective view of the release mechanism 150, which comprises a drum 152 within which is a rotatable shaft 154. A series of spaced discs 158 are secured to the shaft 154 defining parallel compartments within the drum 152. The other end of each of the cable ropes 112 extending from each of the zipper locks 120 passes through the wall of the drum 152 and is secured to the shaft 154 between the spaced discs 158. The cable ropes 112 from each of the zipper locks 120 are spiral wound around the shaft 154 in the same direction and are biased in the direction as indicated by arrow 140 in FIG. 5 by the spring 146 within the receiver 122 such that the leg 142 is received within the aperture 132 so as to be in the normally locked position. The shaft 154 may be spring loaded or biased, such as by a spiral coil spring 156 disposed within the drum 152 and secured at one end to the shaft 154 as is well known in the art, whereby the bias of the coil spring 156 cooperates with the bias of the spring 146 within the receiver 122. It should also be appreciated that the sheaths 114 of each of the cables 110 are secured to the drum 152 such that the sheaths remain fixed to the drum 152 while the cable ropes 112 are free to wind and unwind around the shaft 154. It should also be appreciated that the number of discs 158 may vary depending on the number of cables 110 and corresponding zipper locks 120 provided in the bag 10.

Figure 9:
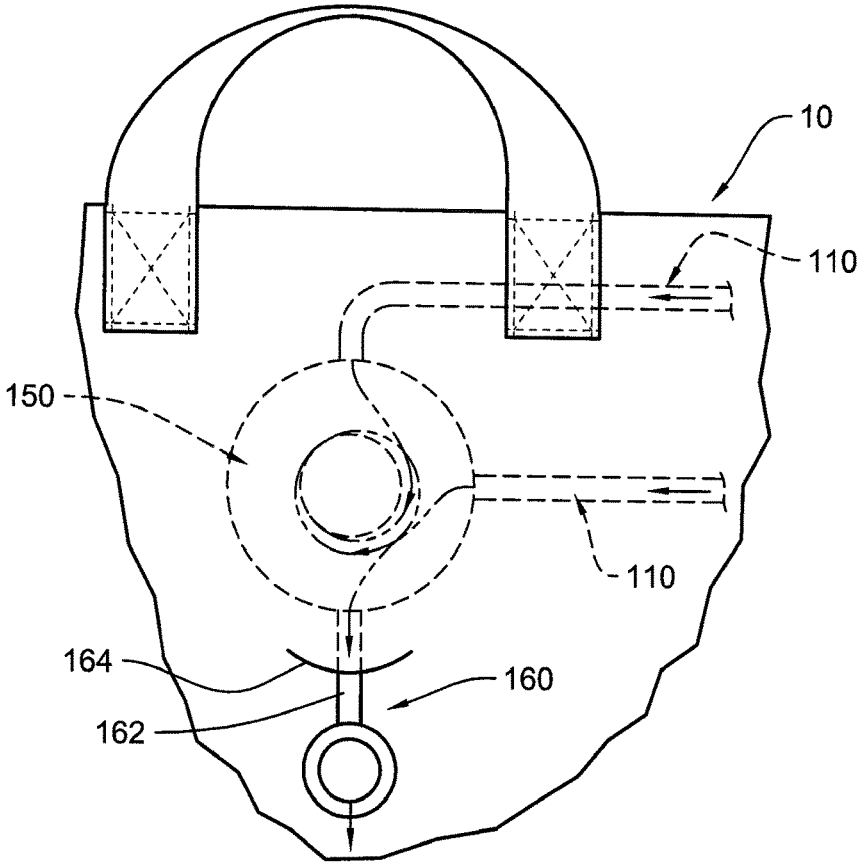
FIG. 9 is a partial rear view of the backpack of FIG. 1 showing an embodiment of the release actuator comprising a pull release and schematically illustrating the operation of the pull release.

A release actuator 160 (FIGS. 2, 7, 9 and 10) is provided to rotate the shaft 154 to cause the cable ropes 112 to each of the zipper locks to be pulled to release or unlock the zipper locks. In one embodiment as illustrated in FIG. 9, the release actuator 160 may be a pull release 162 comprising another cable 110 in which the cable rope 112 extends through the drum 152 and is fixed to the spring loaded shaft 154 and which is wound around the shaft in the same direction as the cable ropes 112 to the zipper locks 120. Thus it should be appreciated that by pulling on the free end of the pull release, the shaft 154 is caused to rotate pulling on the cable ropes 112 as indicated by the arrows in FIG. 9 and the arrow 140 in FIG. 6 thereby rotating the rocker 134 and releasing the legs 142 from the recesses 130 of the locking rods 126 so that the zippers 12 may be unzipped. The free end of the pull release 162 may extend through a slot or opening 164 in the bag 10 such that it may be grasped and pulled by the user to unlock the zipper locks 120.

Figure 10:
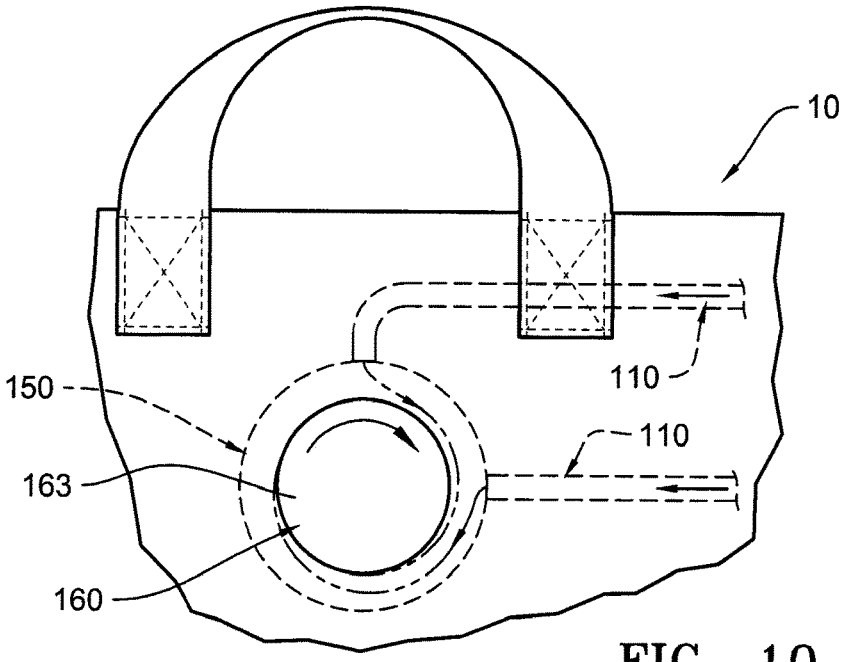
FIG. 10 is a partial rear view of the backpack of FIG. 1 showing an embodiment of the quick release actuator comprising a rotating knob.

In an alternative embodiment as illustrated in FIG. 10, the actuator 160 may comprise a rotatable knob or lever 163 connected so as to rotate the shaft 154 as indicated by the arrows. Thus it should be appreciated that by rotating the knob 163, the shaft 154 is caused to rotate pulling on the cable ropes as indicated by the arrows in FIG. 10 and the arrow 140 in FIG. 6 thereby rotating the rocker 134 and releasing the legs 142 from the recesses 130 in the locking rods 126 so that the zippers 12 may be unzipped. As with the pull cord 162, the rotatable knob or lever may extend through a slot or opening in the bag 10 so it may be grasped and rotated by the user unlock the zipper locks 120.

It should also be appreciated that the actuator 160 is positioned such that it is normally hidden from view and not readily accessible by anyone other than the owner of the bag such that it will not be actuated to unlock the zippers unless intended to be actuated by the owner of the bag. For example, as shown in FIG. 9, with respect to the backpack embodiment and the actuator 160 illustrated as being a pull cord 162, the free end of the pull cord 162 is positioned to extend through the slot opening 164 in the back wall of the backpack 10, which will normally be hidden from view while the backpack is being worn. Thus, even assuming a thief knew that the backpack 10 was equipped with a quick release lock 100 (which is unlikely because the quick release lock 100 is substantially hidden from view), the owner of the bag would likely realize if a thief was attempting to reach between the bag 10 and the owner's back in order to actuate the actuator 160 by pulling on the pull cord 162 to gain access to the contents of the bag 10.

In use, the zippers 12 on each pocket 14 function in the same manner as any other zipper. However, when it is desired to lock the zippers in the closed position, the locking rod 126 secured to the zipper slider 16 is aligned with and pulled into the bore 124 by pulling on the pull tab 18. As the locking rod 126 enters the bore 124, the beveled nose of the locking rod 126 engages the leg 142 of the spring biased rocker 134 forcing the leg 142 upward with respect to the bore 124 and causing the rocker 134 to rotate about pin 136 as indicated by the arrow 144 in FIG. 6. As the rocker 134 rotates, the cable rope 112 is forced downwardly as indicated by arrow 140 in FIG. 6. This release in tension on the cable rope 112 causes a corresponding slight winding of the cable rope around the shaft 154 within the drum 152 of the quick release mechanism 150. When the locking rod 126 is fully received within the bore 124 such that the annular recess 130 is aligned with the aperture 132, the bias of the spring 146 acting on the rocker 134 forces the leg 142 of the rocker 134 to snap down into the annular recess 130 (as illustrated in FIG. 5), causing the cable rope 112 to be pulled as it slightly unwinds from the spring loaded shaft 154, and thereby locking the locking rod 136 within the bore 124 and preventing the zipper from being unzipped. This process is repeated for each of the zipper locks 120.

When it is desired to unlock any one of the zippered compartments 14, the user simply actuates the release actuator 160 (such as by pulling on the free end of the pull release 162 (FIG. 9) or rotating the knob 163 (FIG. 10). The forced rotation of the shaft 154 causes the cable ropes 112 to wind around the shaft 154 resulting in a pulling force on the cable ropes 112 to each of zipper locks 120 causing the rocker 134 to pivot about the pin 136 and thereby raising the legs 142 from the annular recess 130 of the locking rods 126 such that the zippers 12 can be unzipped by pulling on the zipper pull tab 28 as indicated by arrow 148 in FIG. 6.

Although various embodiments have been described above, the details and features of the disclosed embodiments are not intended to be limiting, as many variations and modifications will be readily apparent to those of skill in the art. Accordingly, the scope of the present disclosure is intended to be interpreted broadly and to include all variations and modifications within the scope and spirit of the appended claims and their equivalents.

The invention claimed is:

1. A bag having a quick release zipper lock, comprising:

a bag having a first internal compartment with a first zipper closure, the first zipper closure having a first zipper slider movable between a first end and a second end of the first zipper closure, whereupon when the first zipper slider is moved to the first end, the first zipper closure is closed preventing access to the first internal compartment, and whereupon when the first zipper slider is moved toward the second end, the first zipper closure is open to enable access to the first internal compartment;

a first locking rod secured to an inner side of the first zipper slider;

a first zipper lock secured within the first internal compartment of the bag at the first end of the first zipper closure, the first zipper lock having a first internal bore sized to receive the first locking rod when the first zipper slider is moved to the first end of the first zipper closure, the first zipper lock further including a first spring biased rocker that engages with the first locking rod to lock the first locking rod within the first internal bore when the first zipper slider is moved to the first end of the first zipper closure;

a quick release mechanism having a rotatable shaft biased in a first rotation direction;

a quick release actuator operable to rotate the rotatable shaft in a second direction opposite the first rotation direction;

a first cable having a first end secured to the rotatable shaft and a second end secured to the first spring biased rocker;

whereby upon applying an actuating force to cause rotation of the quick release actuator in the second direction, a length of the first cable is at least partially wound around the rotatable shaft which, in turn, causes the first spring biased rocker attached to the second end of the first cable to disengage with the first locking rod so as to permit the first zipper slider to be moved toward the second end of the first zipper closure for accessing the first internal compartment of the bag.

2. The bag of claim 1 wherein the rotatable shaft is disposed within a drum, the drum disposed within the bag.

3. The bag of claim 1 whereby upon releasing the actuating force applied to the quick release actuator, the spring bias of the rotatable shaft causes the rotatable shaft to again rotate in the first rotation direction causing the length of the first cable to at least partially unwind from the rotatable shaft.

4. The bag of claim 3 wherein the quick release actuator is a pull release cord having one end secured to the rotatable shaft with a length of the pull release cord at least partially wound around the rotatable shaft, and a second end disposed external to the first internal compartment.

5. The bag of claim 4 whereupon applying the actuating force to the pull release cord causes the length of the pull release cord to at least partially unwind from the rotatable shaft and upon releasing the actuating force, the length of the pull release cord at least partially rewinds around the rotatable shaft.

6. The bag of claim 3 wherein the quick release actuator is a rotatable knob disposed external to the first internal compartment.

7. The bag of claim 1, further comprising:

a second internal compartment with a second zipper closure, the second zipper closure having a second zipper slider movable between a first end and a second end of the second zipper closure, whereupon when the second zipper slider is moved to the first end, the second zipper closure is closed preventing access to the second internal compartment, and whereupon when the second zipper slider is moved toward the second end, the second zipper closure is open to enable access to the second internal compartment;

a second locking rod secured to an inner side of the second zipper slider;

a second zipper lock secured within the second internal compartment of the bag at the first end of the second zipper closure, the second zipper lock having a second internal bore sized to receive the second locking rod when the second zipper slider is moved to the first end of the second zipper closure, the second zipper lock further including a second spring biased rocker that engages with the second locking rod to lock the second locking rod within the second internal bore when the second zipper slider is moved to the first end of the second zipper closure;

a second cable having a first end secured to the rotatable shaft and a second end secured to the second spring biased rocker;

whereby upon applying the actuating force to cause rotation of the quick release actuator, the length of the first cable and a length of the second cable at least partially wind around the rotatable shaft which, in turn, causes the first spring biased rocker attached to the second end of the first cable to disengage with the first locking rod and causes the second spring biased rocker attached to the second end of the second cable to disengage with the second locking rod so as to permit the first and second zipper sliders to be moved toward the second ends of the respective first and second zipper closures for accessing the respective first and second internal compartments of the bag.

8. The bag of claim 7 whereby upon releasing the actuating force applied to the quick release actuator, the spring bias of the rotatable shaft causes the rotatable shaft to again rotate in the first rotation direction causing the length of the first cable and the length of the second cable to at least partially unwind from the rotatable shaft and causing the length of the pull release cord to at least partially rewind around the rotatable shaft.

9. The bag of claim 8 whereby upon releasing the actuating force applied to the quick release actuator, the spring bias of the rotatable shaft causes the rotatable shaft to again rotate in the first rotation direction causing the length of the first cable and the length of the second cable to at least partially unwind from the rotatable shaft.

10. The bag of claim 9 wherein the quick release actuator is a pull release cord having one end secured to the rotatable shaft with a length of the pull release cord at least partially wound around the rotatable shaft, and a second end disposed external to the first and second internal compartments.

11. The bag of claim 10 whereupon applying the actuating force to the pull release cord causes the length of the pull release cord to at least partially unwind from the rotatable shaft and upon releasing the actuating force, the length of the pull release cord at least partially rewinds around the rotatable shaft.

12. The bag of claim 11 wherein the quick release actuator is a rotatable knob disposed external to the first and second internal compartments.

13. A bag having at least one quick release zipper lock, comprising:

a bag having at least one internal compartment with a zipper closure, the zipper closure having a zipper slider movable between a first end and a second end of the zipper closure, whereupon when the zipper slider is moved to the first end, the zipper closure is closed preventing access to the at least one internal compartment, and whereupon when the zipper slider is moved toward the second end, the zipper closure is open to enable access to the at least one internal compartment;

a locking rod secured to an inner side of the zipper slider;

a receiver secured within the at least one internal compartment of the bag at the first end of the zipper closure, the receiver having an internal bore sized to receive the locking rod, the receiver having a spring biased rocker that engages with the locking rod to lock the locking rod within the internal bore of the receiver when the zipper slider is moved to the first end of the zipper closure;

a drum disposed within the bag;

a rotatable shaft disposed within the drum, the rotatable shaft being spring biased to rotate in a first rotation direction;

a cable disposed within the bag, one end of the cable secured to the rotatable shaft, a second end of the cable secured to the spring biased rocker of the receiver;

a quick release mechanism having a quick release actuator;

whereby upon applying an actuating force to the quick release actuator, the rotatable shaft is caused to rotate in a second rotation direction opposite the first rotation direction such that a length of the cable is at least partially wound around the rotatable shaft which, in turn, causes the spring biased rocker attached to the second end of the cable to disengage with the locking rod so as to permit the zipper slider to be moved toward the second direction of the zipper closure for accessing the at least one internal compartment of the bag.

14. The bag of claim 13 whereby upon releasing the actuating force applied to the quick release actuator, the spring bias of the rotatable shaft causes the rotatable shaft to again rotate in the first rotation direction causing the length of the cable to at least partially unwind from the rotatable shaft.

15. The bag of claim 14 wherein the quick release actuator is a pull release cord having one end secured to the rotatable shaft with a length of the pull release cord at least partially wound around the rotatable shaft, and a second end disposed external to the at least one internal compartment.

16. The bag of claim 15 whereupon applying the actuating force to the pull release cord causes the length of the pull release cord to at least partially unwind from the rotatable shaft and upon releasing the actuating force, the length of the pull release cord at least partially rewinds around the rotatable shaft.

17. The bag of claim 16 wherein the quick release actuator is a rotatable knob disposed external to the at least one internal compartment.

* * * * *